United States Patent [19]

Sandt

[11] 4,061,137

[45] Dec. 6, 1977

[54] KINESITHERAPEUTIC BED STRUCTURE

[76] Inventor: Clayton Sandt, P.O. Box 243, Mt. Pocono, Pa. 18344

[21] Appl. No.: 717,216

[22] Filed: Aug. 24, 1976

[51] Int. Cl.[2] ..... A61H 1/00

[52] U.S. Cl. ..... 128/33; 128/46

[58] Field of Search ..... 128/33, 25 B, 24.2, 128/46, 44

[56] References Cited

U.S. PATENT DOCUMENTS

| | | | |
|---|---|---|---|
| 2,284,445 | 5/1942 | Pettit | 128/46 |
| 2,821,191 | 1/1958 | Pall | 128/33 |
| 2,936,754 | 5/1960 | Mandl et al. | 128/33 |
| 2,945,492 | 7/1960 | Harvey | 128/33 |
| 3,014,478 | 12/1961 | Ware | 128/33 |
| 3,043,293 | 7/1962 | Rider | 128/33 |
| 3,062,205 | 11/1962 | Loiacano | 128/33 |
| 3,207,152 | 9/1965 | Thornton | 128/33 |
| 3,326,209 | 6/1967 | Mandl | 128/33 |

*Primary Examiner*—Lawrence W. Trapp

[57] ABSTRACT

A kinesitherapeutic bed structure includes a bed frame and a body-supportable coil spring assembly carried by the frame. An upper vibratory element is accommodated within an opening in the coil spring assembly. A motion generating mechanism is carried by the bed frame and includes top and bottom plate elements which are reciprocable in horizontal planes in mutually perpendicular directions. The upper vibratory element is carried by the top plate element for movement therewith. Drive means are provided for independently imparting horizontal movement to the top and bottom plates and vertical movement to the upper vibratory element. The upper vibratory element thus is adapted to transmit to the person supported on the coil spring assembly motion in the horizontal and vertical directions representative of the movement of the top and bottom plate elements and the upper vibratory element respectively.

6 Claims, 5 Drawing Figures

KINESITHERAPEUTIC BED STRUCTURE

BACKGROUND OF THE INVENTION

The present invention relates to a kinesitherapeutic bed structure.

Therapeutic structures have been known heretofore in which a mechanism is provided for imparting vibratory or gyratory movements to a piece of furniture such as a couch or bed. The value of such gentle vibratory and gyratory movements in the improvement of circulation, relaxation of nervious tensions, and in generally improving the health of the user has been recognized prior to the present invention. However, the prior devices utilized a motor with an unbalanced armature or drive shaft to develop the vibratory movements. U.S. Pat. No. 3,279,461 issued Oct. 18, 1966 to C. Oliver, for example, discloses a vibratory unit for box springs in which the motor shaft is given a depending arm and weight. When the motor is energized a uniform rhythmic vibration is produced due to the eccentrically weighted device which is transmitted to the member to which the device is anchored. However, due to the eccentric loading of such motor shafts excessive and uneven wear is imposed upon the shaft bearings and other components of the device resulting in unpredictable vibratory movement which tends to offset much of the beneficial effects derived from the device. Eventually such unbalanced forces in the device lead to premature failure of the device. Further, devices of the character described have not afforded independently controllable movement in selected horizontal and vertical directions.

SUMMARY OF THE INVENTION

It is one object of the invention to provide a kinesitherapeutic bed structure which does not rely upon the development of unbalanced forces on the motor shaft to create the desired vibratory movements.

It is another object of the invention to provide a kinesitherapeutic bed structure in which horizontal and vertical movements may be imparted selectively and independently.

It is still another object of the invention to provide a kinesitherapeutic bed structure capable of producing predictable selective movements over an increased period of operational longevity.

Other objects and advantages of the invention will become readily apparent from the following description of the invention.

According to the present invention there is provided . . . claim 1.

BRIEF DESCRIPTION OF THE DRAWINGS

In order that the invention may be more fully comprehended it will now be described, by way of example, with reference to the accompanying drawings in which.

DETAILED DESCRIPTION OF THE PREFERRED EMBODIMENT

Figure 1:
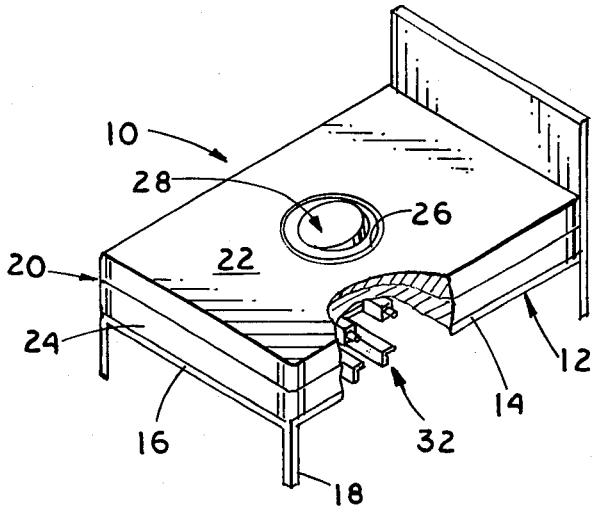
FIG. 1 is a perspective view of a kinesitherapeutic bed structure embodying the features of the invention.

Referring to the drawings there is shown generally, as indicated by reference numeral 10, a kinesitherapeutic bed structure. As depicted the structure includes a bed frame 12 having longitudinally extending frame members 14 and transverse end members 16. The bed structure is supported on frame legs 18.

A body-supportable coil spring assembly 20 reposes on the bed frame and may include a mattress 22 and box spring 24. The assembly is given an opening 26 dimensioned to accommodate an upper vibratory element 28 therewithin. In its horizontal disposition the vibratory element 28 lies in substantially the same horizontal plane as the upper surface of mattress 22 so as to constitute an effective continuation thereof and thus provide the usual comfort expected of the mattress. As can be seen most clearly from FIG. 3 a covering 30 is desirably provided over the plate-like vibratory element conforming closely in resiliency to that of the mattress.

Figure 2:
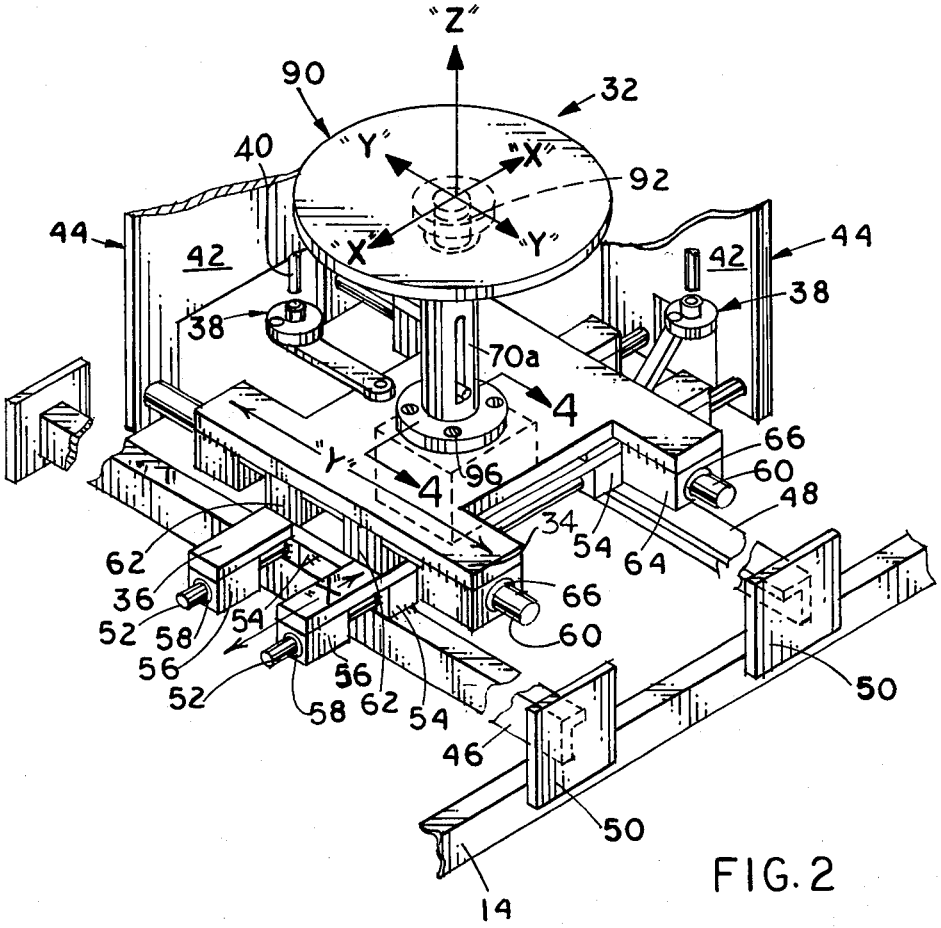
FIG. 2 is an enlarged perspective view of the motion developing mechanism in accordance with the invention.

A motion generating mechanism 32 is mounted on the bed frame beneath the box spring, the upper vibratory element 28 thereof extending upwardly into the opening in the coil spring assembly as previously described. Referring to FIG. 2, the motion generating mechanism comprises top and bottom plate elements 34, 36 which are reciprocable in closely adjacent horizontal planes in mutually perpendicular directions. Thus, the bottom plate 36 is reciprocable in the "X" directions whereas top plate 34 is reciprocable in the "Y" directions.

Each of the top and bottom plate elements and the upper vibratory element are operable independently. Thus, in order to effect movement of the top and bottom plate elements there is mounted on each such plate element a rotatable cam 38 drivable by means of a motor shaft or motor driven shaft 40. Cams 38 are engageable with a camming surface 42 which may constitute the adjacent wall of a motor mounting plate 44. It will be understood, of course, that such motors (not shown) may be of the variable speed type and indeed are desirably so controlled.

The motion generating mechanism 32 includes at least two rails 46, 48 which are parallel and are of sufficient length to be affixed to the longitudinally extending frame members 14. If so desired the rails may be provided with a mounting bracket 50 at each end to facilitate securing of the mechanism to the bed frame. A first set of shafts 52 are carried fixedly on the rails as by being provided with box members 54 that are preferably welded to the rails. The bottom plate element 36 is given journals 56 with brushing elements 58 such that it may be reciprocated along shafts 52 in the "X" directions through selective driving of cam 38 mounted thereon. A second set of shafts 60 having box members 62 secured thereto are carried atop the bottom plate element. Box members 62 are affixed to the bottom plate element so as to transmit the reciprocatory movement of the bottom plate element to the top plate element. However, the top plate element 34 is given journals 64 with brushing elements 66 to enable the top plate element to be reciprocated along shafts 60 in the "Y" directions through rotation of cam 38 mounted on the top plate element.

Figure 3:
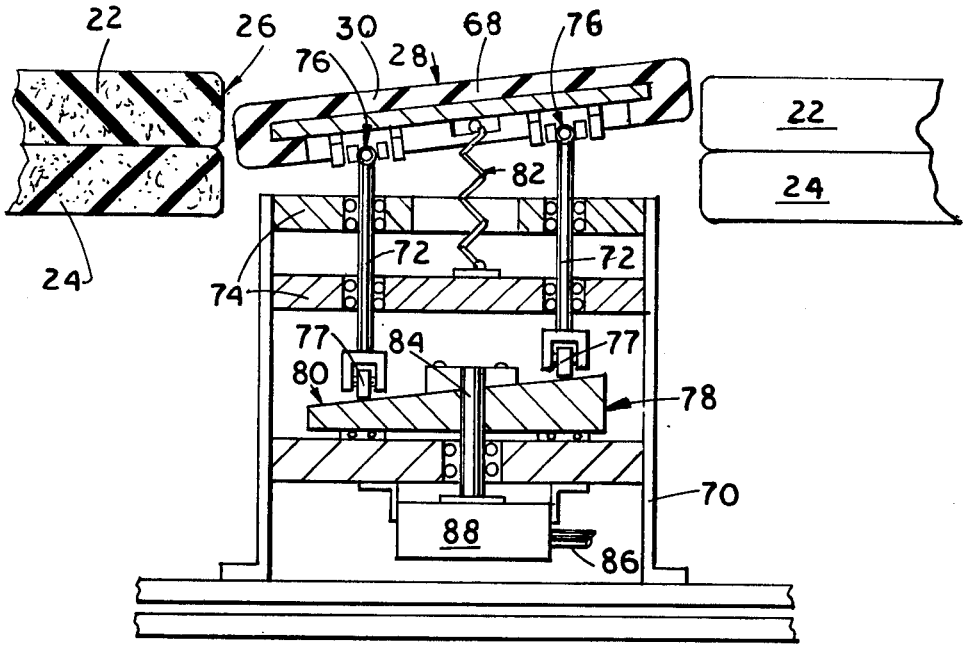
FIG. 3 is a side elevational view, partly in cross-section, showing one form of vertical motion developing mechanism and a portion of the bed structure.

The upper vibratory element in accordance with the embodiment illustrated in FIG. 3 comprises a wobble plate 68. As shown in this figure a hollow support cylinder 70 is fixedly mounted on top plate 34. A plurality of push rods 72 are positioned within the support cylinder and are guided vertically within the aligned apertures of at least one push rod alignment plate 74. Desirably two of such alignment plates are carried internally of the support cylinder. The upper ends of the push rods, and there are preferably four such push rods spaced equidistantly within the support cylinder, are connected pivotably to the wobble plate such as by means of universal joints 76. The lower ends of the push rods are provided with roller means 77 for a purpose which will shortly become clear. A tilt plate 78 is rotatably mounted within the support cylinder and is given an upper support surface 80 which is contoured in a predetermined manner such that it may serve as a camming surface. The rollers 77 repose on support surface 80 and, as will be appreciated, as the tilt plate is caused to rotate the push rods are sequentially raised and lowered to thereby transmit the desired vertical wobbling movement to wobble plate 68. The wobble plate is resiliently mounted on one of the push rod alignment plates by means of a spring 82. The tilt plate is mounted upon shaft 84 which is driven by motor shaft or motor driven shaft 86 through the gear box 88. Thus, selective actuation of the motor which drives shaft 86 results in rotation of the tile plate, reciprocation of push rods 72, and the imparting of vertical movement of a predetermined pattern determined by the contour of the upper surface of the tilt plate to the wobble plate.

Figure 4:
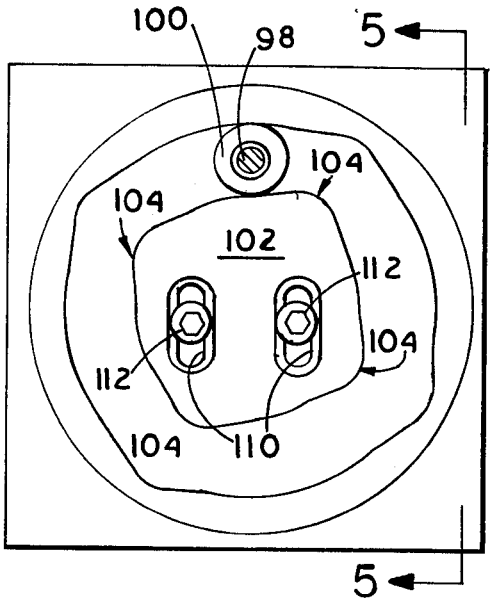
FIG. 4 is an end view of a second form of vertical motion developing mechanism as seen along line 4—4 of FIG. 2.
Figure 5:
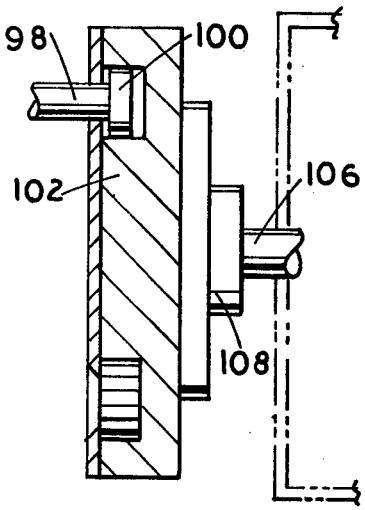
FIG. 5 is a side view, partly in cross-section, of the vertical motion developing mechanism shown in FIG. 4 when viewed along line 5—5 of FIG. 4.

In accordance with the embodiment illustrated in FIGS. 2, 4 and 5 the upper vibratory element comprises a vertical motion plate 90 which surmounts a vertical shaft 92. Shaft 92 is mounted slidably within hollow support cylinder 70*a* which is given a vertically extending slot 94 in a side wall thereof. As with support cylinder 70 cylinder 70*a* is secured fixedly to the top plate 34 such as by a series of bolts or screws 96. The shaft 92 is provided with drive rod 98 integral therewith and projecting laterally thereof through slot 94. The drive rod carries at its outer end a cam follower 100 adapted to ride on a rotatable cam 102. Desirably cam follower 100 is a roller so as to minimize friction between same and the cam. The cam may be given a plurality of lobes 104 adapted to cause the drive rod to be cyclically reciprocated vertically. In so rising and falling the drive rod imparts the desired vertical movement to the vertical motion plate 90 which is adapted to fit within the opening in the coil spring assembly as previously described. Cam 102 is rotatable by means of motor shaft or motor driven shaft 106 to which it is operably connected such as by means of coupling 108. A pair of slots 110 may be formed in a face of the cam and a pair of cap screws 112 are insertable through such slots and may be tightened to set the cam at a desired position. Adjustment of the cam can thus be effected by means of the cap screws.

From the foregoing it will be seen that a kinesitherapeutic bed structure has been provided in which horizontal and vertical movement may be selectively generated and transmitted to an upper vibratory element. Such element applies the vibratory motion directly to the person supported on the bed without generating unnecessary vibratory forces throughout the coil spring assembly or by means of the bed frame as was effected in prior structures. Due to the direct application of vibratory motion to the person occupying the bed rather than indirectly upon either the bed frame or coil spring assembly it is possible to reduce the power requirements of the unit.

I claim:

1. A kinesitherapeutic bed structure comprising in combination:

a bed frame;

a coil spring assembly carried by said frame and adapted to support a person thereon, said coil spring assembly having an opening therein dimensioned to accommodate the upper vibratory element of a motion generating mechanism therewithin;

and a motion generating mechanism carried by said frame and including top and bottom plate elements reciprocable respectively in horizontal vertically spaced planes in mutually perpendicular directions, an upper vibratory element carried by said top plate element for reciprocatory movement therewith, and means for independently imparting horizontal reciprocatory movement to each of said top and bottom plate elements and vertical movement to said upper vibratory element.

2. A bed structure according to claim 1, including at least two parallel spaced support rails adapted to be mounted on said bed frame, a first set of support shafts carried fixedly by said support rails and extending transversely of said rails, said bottom plate element being mounted on said first set of support shafts for reciprocatory movement therealong, a second set of support shafts carried fixedly by said bottom plate element in overlying relation thereto and extending transversely of said first set of support shafts, and said top plate element being mounted on said second set of support shafts for reciprocatory movement therealong.

3. A bed structure according to claim 1, wherein rotatable cam means are provided on each of said top and bottom plate elements operatively connected respectively to separate motordriven shafts, a camming surface being provided adjacent each of said cam means, whereby selective rotation of said cam means and engagement thereof with the camming surface adjacent thereto effects reciprocatory movement of the plate element associated therewith, such reciprocatory movement being transmitted by said top plate element to the upper vibratory element carried thereby.

4. A bed structure according to claim 1, wherein said upper vibratory element comprises a wobble plate, a hollow support cylinder being fixedly mounted on said top plate, a plurality of vertical push rods being mounted within said support cylinder having the upper ends thereof connected pivotably to said wobble plate and the lower ends thereof being provided with roller means, a tilt plate having an upper camming surface rotatably mounted within said support cylinder, spring means being provided for resiliently biasing said wobble plate downwardly and said roller means into engagement with the camming surface of said tilt plate, at least one push rod alignment plate being mounted within said support cylinder having apertures extending therethrough dimensioned to guide said push rods slidably during the vertical movement thereof, and a motor driven shaft operably connected to said tilt plate for rotating same, whereby rotation of said tile plate effectuates vertical reciprocatory movement of said push rods in a predetermined pattern and transmits the desired vertical movement to said wobble plate.

5. A bed structure according to claim 1, wherein said upper vibratory element comprises a vertical motion plate mounted atop a vertical shaft, a hollow support cylinder enclosing said vertical shaft and being fixedly mounted on said top plate, a vertical slot being formed in a side wall of said support cylinder, a drive rod connected fixedly to said vertical shaft and projecting laterally therefrom and through said slot, said vertical shaft being reciprocable within said support cylinder and said drive rod being adapted to reciprocate within said vertical slot, and a motor driven shaft operably connected to said drive rod for reciprocating same and thereby imparting vertical movement to said vertical motion plate.

6. A bed structure according to claim 1, wherein said coil spring assembly includes a mattress and box spring and said opening extends through both of said mattress and box spring.

* * * * *